US007100695B2

(12) United States Patent
Reitz

(10) Patent No.: US 7,100,695 B2
(45) Date of Patent: Sep. 5, 2006

(54) GAS RECOVERY APPARATUS, METHOD AND CYCLE HAVING A THREE CHAMBER EVACUATION PHASE AND TWO LIQUID EXTRACTION PHASES FOR IMPROVED NATURAL GAS PRODUCTION

(76) Inventor: Donald D. Reitz, 7484 E. Cedar Ave., Denver, CO (US) 80230

( * ) Notice: Subject to any disclaimer, the term of this patent is extended or adjusted under 35 U.S.C. 154(b) by 363 days.

(21) Appl. No.: 10/700,296

(22) Filed: Nov. 3, 2003

(65) Prior Publication Data

US 2004/0123987 A1 Jul. 1, 2004

Related U.S. Application Data

(63) Continuation-in-part of application No. 10/096,881, filed on Mar. 12, 2002, now Pat. No. 6,672,392.

(51) Int. Cl.
*E21B 43/12* (2006.01)

(52) U.S. Cl. ..... 166/372; 166/53; 166/68

(58) Field of Classification Search ..... 166/53, 166/68, 372; 417/137, 138, 142, 144, 145, 417/149

See application file for complete search history.

(56) References Cited

U.S. PATENT DOCUMENTS

| | | | |
|---|---|---|---|
| 1,853,269 | A | 4/1932 | Harris |
| 2,016,433 | A | 10/1935 | Humason |
| 2,142,773 | A | 1/1939 | Athey |
| 2,698,581 | A | 1/1955 | Maier |
| 3,090,316 | A | 5/1963 | Montgomery |
| 3,884,299 | A | 5/1975 | McCarter et al. |
| 3,894,583 | A | 7/1975 | Morgan |
| 3,941,510 | A | 3/1976 | Morgan |
| 3,991,825 | A | 11/1976 | Morgan |
| 4,502,843 | A | 3/1985 | Martin |
| 4,509,599 | A | 4/1985 | Chenoweth et al. |

(Continued)

FOREIGN PATENT DOCUMENTS

| | | |
|---|---|---|
| SU | 570697 | 8/1977 |

OTHER PUBLICATIONS

Kermit Brown, *The Technology of Artificial Life Methods*, vol. 2, pp. 125–131, 1977.

E.E. DeMoss, *4 New Ways to Reduce Artificial Lift Expense*, World Oil, pp. 63 and 64, May 1973.

H.W. Winkler et al., *Down–Hole Chambers Increase Gas–Lift Efficiency*, The Petroleum Engineer, part 1—Jun. 1956; part 2—Aug. 1956.

H.W. Winkler et al., *Chamber Design, CAMCO Gas Lift Manual*, Chapter VII, pp. 7–001–7–015, 1962.

John T. Dewan, et al., *Lifting of Heavy Oil with Inert–Gas–Operated Chamber Pumps*, SPE 9913, pp. 277–285 plus illustrations.

Steve B. Coleman et al., *A New Look at Predicting Gas–Well Load–Up*, JPT, Mar., 1991.

Steve B. Coleman et al., *Understanding Gas–Well, Load–Up Behavior*, JPT, Mar., 1991.

E.E. DeMoss et al., *Liquid Removal from Gas Wells—Gas Lifting with Reservoir Gas*, Apr. 1968.

*Primary Examiner*—Hoang Dang
(74) *Attorney, Agent, or Firm*—John R. Ley

(57) ABSTRACT

Natural gas produced from a well by executing a multiple-phase gas recovery cycle which includes a phase during which a relatively lower evacuation pressure is applied within three chambers in the well to assist in accumulating liquids at a well bottom, followed by a liquid reduction phase which clears the liquid from two of the chambers while leaving the liquid in the third chamber. The remaining liquid is thereafter lifted in subsequent liquid capture and liquid removal phases. The liquid reduction phase clears the fluid from the well more effectively with less interruption in the production of gas from the well while maintaining the full gas productivity of the well.

36 Claims, 7 Drawing Sheets

U.S. PATENT DOCUMENTS

| | | | | |
|---|---|---|---|---|
| 4,527,633 | A | | 7/1985 | McLaughlin et al. |
| 4,653,989 | A | | 3/1987 | Mason |
| 4,708,595 | A | | 11/1987 | Maloney et al. |
| 4,711,306 | A | | 12/1987 | Bobo |
| 4,741,673 | A | | 5/1988 | Jubb |
| 4,768,595 | A | | 9/1988 | Smith |
| 4,844,156 | A | | 7/1989 | Heshberger |
| 4,923,372 | A | | 5/1990 | Ferguson et al. |
| 5,006,046 | A | | 4/1991 | Buckman et al. |
| 5,069,285 | A | | 12/1991 | Nuckols |
| 5,211,242 | A | | 5/1993 | Coleman et al. |
| 5,374,163 | A | | 12/1994 | Jaikaran |
| 5,407,010 | A | | 4/1995 | Herschberger |
| 5,417,281 | A | | 5/1995 | Wood et al. |
| 5,431,222 | A | | 7/1995 | Bustamante |
| 5,488,993 | A | | 2/1996 | Hershberger |
| 5,522,463 | A | | 6/1996 | Barbee |
| 5,544,706 | A | | 8/1996 | Reed |
| 5,611,397 | A | | 3/1997 | Wood |
| 5,611,671 | A | | 3/1997 | Tripp, Jr. |
| 5,655,605 | A | | 8/1997 | Matthews |
| 5,671,813 | A | | 9/1997 | Lima |
| 5,911,278 | A | | 6/1999 | Reitz |
| 6,672,392 | B1 | * | 1/2004 | Reitz ..... 166/372 |
| 6,830,108 | B1 | * | 12/2004 | Rogers, Jr. ..... 166/372 |
| 2002/0007953 | A1 | * | 1/2002 | Liknes ..... 166/372 |

* cited by examiner

GAS RECOVERY APPARATUS, METHOD AND CYCLE HAVING A THREE CHAMBER EVACUATION PHASE AND TWO LIQUID EXTRACTION PHASES FOR IMPROVED NATURAL GAS PRODUCTION

CROSS-REFERENCE TO RELATED INVENTION

This is a continuation in part of a previous invention described in U.S. patent application Ser. No. 10/096,881, filed Mar. 12, 2002, titled "Gas Recovery Apparatus, Method and Cycle Having a Three Chamber Evacuation Phase for Improved Natural Gas Production and Down-Hole Liquid Management," now U.S. Pat. No. 6,672,392. The subject matter from this application is incorporated herein by this reference.

FIELD OF THE INVENTION

This invention relates primarily to producing natural gas from a well having three chambers, and more particularly to a new and improved gas recovery system, method and gas recovery cycle having one phase in which an evacuation pressure is applied to the three chambers and a hydrocarbon-bearing zone of the earth formation to assist natural formation pressure in producing natural gas and liquid into the well, followed by two separate liquid extraction phases which remove significantly more liquid from the well to increase the efficiency of gas production and to prevent certain types of wells from being slowly choked off by accumulated liquid if the technique described in the above-referenced U.S. patent application is employed on those types of wells.

BACKGROUND OF THE INVENTION

The production of oil and natural gas depends on natural pressure within the earth formation at the bottom of a well bore, as well as the mechanical efficiency of the equipment and its configuration within the well bore to move the hydrocarbons from the earth formation to the surface. The natural formation pressure forces the oil and gas into the well bore. In the early stages of a producing well when there is considerable formation pressure, the formation pressure may force the oil and gas entirely to the earth surface without assistance. In later stages of a well's life after the formation pressure has diminished, the formation pressure is effective only to move liquid and gas from the earth formation into the well. The formation pressure pushes liquid and gas into the well until a hydrostatic head created by a column of accumulated liquid counterbalances the natural earth formation pressure. Then, a pressure equilibrium condition exists and no more oil or gas or water flows from the earth formation into the well. The hydrostatic head pressure from the accumulated liquid column chokes off the further flow of liquid into the well bore, causing the well to "choke off" or "die," unless the accumulated liquid is pumped or lifted out of the well.

By continually removing the liquid, the hydrostatic head pressure from the accumulated column of liquid remains less than the natural earth formation pressure. Under such circumstances, the natural earth formation pressure continues to move the liquid and gas into the well, allowing the liquid and gas to be recovered or produced. At some point when the natural earth formation pressure has diminished significantly, the cost of removing the liquid diminishes the value of the recovered oil and gas to the point where it becomes uneconomic to continue to work the well. Under those circumstances, the well is abandoned because it is no longer economically productive. A deeper well will require more energy to pump the liquid from the well bottom, because more energy is required to lift the liquid the greater distance to the earth surface. Deeper wells are therefore abandoned with higher remaining formation pressure than shallower wells.

To keep a well in production, it is necessary to remove the accumulated liquid to prevent the liquid from choking off the flow of gas. Because a considerably greater volume of gas is usually produced into a well compared to the amount of liquid produced into the well, the greater volume of gas can be recovered more economically by removing a relatively lesser volume of the accumulated liquid. Consequently, there may be an economic advantage to recovering natural gas at the end of a well's lifetime, because the gas is more economically recovered as a result of removing a relatively smaller amount of accumulated liquid. These factors are particularly applicable to recovering gas from relatively deep wells.

Gas pressure lift systems have been developed to lift liquid from wells under circumstances where mechanical pumps would not be effective or not sufficiently economical. In general, gas pressure lift systems inject pressurized gas into the well to force the liquid up from the well bottom, rather than rely on mechanical pumping devices to lift the liquid. The injected gas may froth the liquid by mixing the heavier density liquid with the lighter density gas to reduce the overall density of the lifted material. Alternatively, "slugs" or shortened column lengths of liquid are separated by bubble-like spaces of pressurized gas, again reducing the overall density of the lifted material. In both cases, the amount of energy required to lift the material is reduced, or for a given amount of energy it is possible to lift material from a greater depth.

One problem with injecting pressurized gas into a well casing is that the pressurized gas tends to oppose the natural formation pressure. The injected gas pressure counterbalances the formation pressure to inhibit or diminish the flow of liquids and natural gas into the well. Once the injected gas pressure is relieved, the natural earth formation will again become effective to move the liquid and gas into the well. However, because the casing annulus is pressurized for a significant amount of time during each production cycle, the net effect is that the injected gas pressure diminishes the production of the well. Stated alternatively, producing a given amount of liquid and gas from the well requires a longer time period to accomplish. Such reductions in the production efficiency in the later stages of the well's life may be so significant that it becomes uneconomical to work the well, even though some amount of hydrocarbons remain in the formation.

One type of pressurized gas lift apparatus, method and gas recovery cycle which is particularly advantageous for use with wells having relatively low down-hole natural earth formation pressure is described in the above-identified U.S. patent. In that technique, a three chamber evacuation phase is included in each gas recovery cycle to create a relatively low pressure throughout the well and thereby augment the natural earth formation pressure to draw more gas and liquid from the surrounding earth formation into the bottom of the well. The relatively low pressure is communicated from the earth surface down into the well through a casing chamber, a production chamber and a lift chamber. Liquid is forced from the casing chamber into the production and lift chambers and is then lifted to the earth surface through the lift chamber by applying a relatively high pressure to the production chamber. A one-way valve at the bottom of the production chamber allows fluid to flow from the casing chamber into the production chamber, but the one-way valve confines the relatively high pressure in the production chamber when the liquid is lifted up the lift chamber to the earth surface. After the liquid is lifted in this manner, at least a significant portion of the gas is produced through the same path up the casing chamber, down the production chamber and then up the lift chamber.

The three chamber evacuation phase in the gas recovery cycle is particularly advantageous in improving the efficiency and maintaining the productivity of relatively deep wells having relatively low natural earth formation pressures and which produce liquid at a relatively low rate. Because liquid is produced at a relatively low rate, it is possible to use the three chamber evacuation phase as a primary gas production phase. The gas is produced directly up the casing chamber, and the gas is not subject to the flowing friction losses created by the relatively lengthy flow path down the smaller diameter production chamber and then up the even smaller diameter lift chamber. The flowing friction losses through the shortest flow path and largest diameter casing chamber are substantially less than the more circuitous and friction-engendering path up the casing chamber, down the production chamber and then up the lift chamber.

The technique of the above-identified U.S. patent is best implemented in these low earth formation pressure-low liquid production wells by minimizing the amount of time or proportion of each gas recovery cycle required to perform the liquid capture, liquid removal and production phases during which the liquid is removed from the casing chamber and lifted to the earth surface. The relatively low rate of liquid production by the well permits minimizing these phases while maximizing the more efficient gas producing three chamber evacuation phase.

SUMMARY OF THE INVENTION

It has been discovered that minimizing the liquid capture, liquid removal and production phases may not fully remove all of the removal liquid from the bottom of certain wells with low natural earth formation pressure and low liquid production. A slight residual amount of liquid remains in the casing chamber after executing each gas recovery cycle, and that residual amount of liquid will build up with repetitions of the gas recovery cycle to the point where the liquid begins to choke the well and diminish gas production. While it is possible to extend the liquid capture, gas removal and production phases to a greater proportion of the gas recovery cycle to lift more liquid, extending those phases diminishes the gas production efficiency because of the greater flowing friction losses during those phases. Executing a special cycle on an aperiodic basis to eliminate the residual accumulated liquid that has not been removed during each normal gas recovery cycle is also not desired. It is difficult and inconvenient to change the operation of the well to execute only a few of these cycles on an aperiodic basis, and the less skilled personnel which normally administer the production of a well may be incapable of changing the well operation to accommodate aperiodic operational differences.

The present invention improves the gas recovery technique described in the above-identified U.S. patent, by including a liquid reduction phase in each gas recovery cycle. In general, the liquid reduction phase assures that all of the recoverable liquid from the well bottom will be lifted during each gas recovery cycle, thereby preventing slight residual amounts of liquid from accumulating over time to the point where the productivity of the well is diminished or terminated. The use of the liquid reduction phase also shortens the amount of time consumed during each recovery cycle by the more inefficient liquid capture, liquid removal and production phases. Consequently, the efficiency of gas production from the well is improved because less time is consumed in forcing gas through the lengthy and friction-prone path from the earth surface down the production chamber and back up the lift chamber. In a similar sense, the time during which gas may be produced in the more efficient three chamber evacuation phase is extended, because the liquid reduction phase maintains the relatively low pressure on the casing chamber to encourage liquid and gas flow into the well, and because more liquid can be lifted during each gas recovery cycle without increasing the amount of time when the relatively low pressure in the casing chamber must be terminated or changed to a relatively high pressure, as occurs during the liquid capture phase.

These and other improvements and benefits are realized from a method of recovering natural gas from a well in a multiple phase gas recovery cycle. The well has a casing chamber defined by a casing within the well, a production chamber within a production tubing inserted into the casing chamber and a lift chamber defined by a lift tube inserted within the production chamber. The well also includes a one-way valve separating the production chamber from the casing chamber. The gas recovery cycle includes a three chamber evacuation phase in which a relatively low pressure is applied within the casing chamber, the production chamber and the lift chamber to cause the relatively low pressure to augment natural earth formation pressure and flow more liquid and gas into the casing chamber than would flow only from the natural formation pressure. The gas recovery cycle also includes a liquid capture phase in which relatively high pressure gas is applied to the casing chamber to move liquid within the casing chamber through the one-way valve into the production chamber, and a liquid removal phase in which relatively high pressure gas is applied to the production chamber to close the one-way valve and to isolate the production chamber from the casing chamber and to lift liquid isolated in the production chamber up the lift chamber. Lastly, the gas recovery cycle includes a liquid reduction phase executed after the three chamber evacuation phase and before the liquid capture phase. The liquid reduction phase is executed by applying relatively high pressure within the production chamber to close the one-way valve and to isolate the production chamber from the casing chamber and to lift the liquid accumulated within the production chamber during the three chamber evacuation phase out of the well through the lift chamber, while maintaining the relatively low pressure within the casing chamber.

In the context of this type of gas recovery, two other related aspects of the present invention involve the use of a liquid reduction phase in a gas recovery cycle, during which a relatively high pressure is applied to the production chamber while a relatively low pressure is applied to the casing chamber while the lift chamber is opened to flow liquid and gas therethrough to the earth surface; and lifting liquid accumulated within the production chamber during the evacuation phase out of the well through the lift chamber; while maintaining the relatively low pressure within the casing chamber. Moreover, other aspects of the present invention relate to a controller used in conjunction with control valves connected to and between the casing chamber, the production chamber, the lift chamber, and suction and discharge manifolds of a compressor, in which the controller is programed to supply control signals to the control valves to establish opened and closed states of the control valves to execute this type of gas recovery cycle.

A more complete appreciation of the present invention and its scope may be obtained from the accompanying drawings, which are briefly summarized below, from the following detail descriptions of presently preferred embodiments of the invention, and from the appended claims.

DETAILED DESCRIPTION

Figures 1, 2:
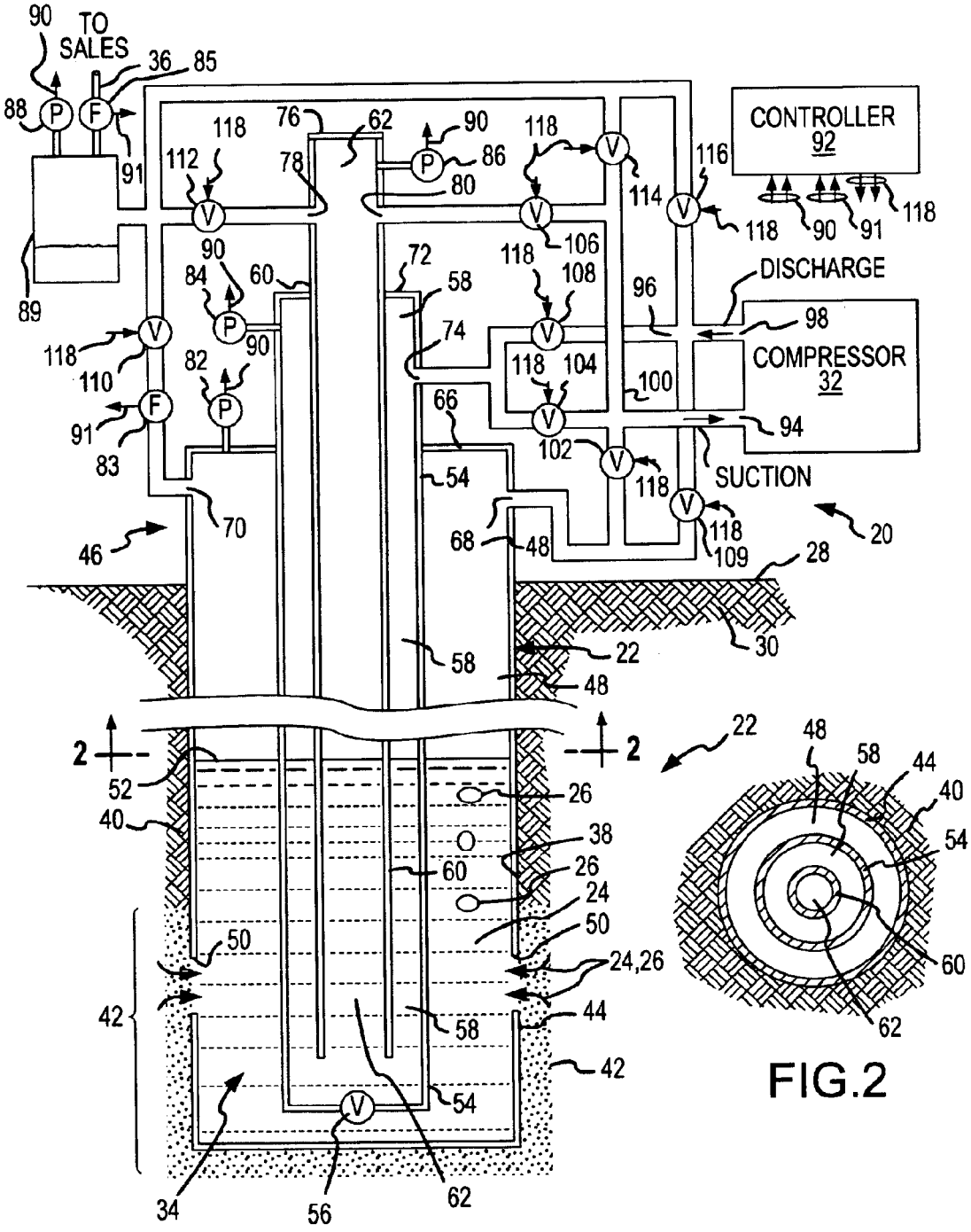
FIG. 1 is a schematic and block diagram of a gas recovery apparatus of the present invention installed in a schematically-illustrated natural gas producing well, all of which also illustrates the methodology for the present invention
FIG. 2 is cross-section view of the well shown in FIG. 1, taken substantially in the plane of line 2—2 of FIG. 1.

A gas recovery apparatus 20 which operates in accordance with the present invention is shown in FIG. 1, used in a well 22 which produces liquid 24 and natural gas 26. The liquid 24, which is primarily water in a gas well but which may contain some oil, is lifted out of the well 22 to the surface 28 of the earth 30 by operation of the gas recovery apparatus 20. In general, the gas recovery apparatus 20 includes a compressor 32 which supplies pressurized gas, preferably pressurized natural gas 26, to a bottom 34 of the well 22. The pressurized gas forces the liquid 24 accumulated in the well bottom 34 to the surface 28. Natural gas 26 is also removed from the well at the earth surface 28, and the produced natural gas 26 is delivered to a sales conduit 36 for later commercial sales and use.

The well 22 is formed by a well bore 38 which has been drilled or otherwise formed downward into a subterranean formation 40 of the earth 30. The well bore 24 extends downward to a depth or level where it penetrates a subterranean zone 42 which contains the natural gas 26. A conventional well casing 44 is inserted into the well bore 38 to preserve the integrity of the well 22. The casing 44 is typically formed by a number of connected pipes or tubes (not individually shown) which extend from a wellhead 46 at the surface 28 down to the well bottom 34. In relatively shallow and moderate-depth wells 22, the connected pipes which form the casing 44 extend continuously from the wellhead 46 to the well bottom 34. In relatively deeper wells 22, a conventional liner (not shown) is formed by connected pipes or tubes of lesser diameter at the lower depths of the well bore 38. The liner functions to maintain the integrity of the well 22 at its lower depths. A conventional packer (not shown) is used to transition from the relatively larger diameter casing 44 to the relatively smaller diameter liner at the mid-depth location where the liner continues on from the lower end of the casing 44. Because the liner can be considered as a smaller diameter version of the casing 44, the term "casing" is used herein to refer both to the circumstance where only a single diameter pipe extends from the earth surface 28 to the well bottom 34, and to the circumstance where larger diameter pipe extends from the earth surface 28 part way down the well bore 38 to a point where slightly lesser diameter liner continues from a packer on to the well bottom 34. The interior area circumscribed by the casing 44 is referred to as a casing chamber 48 (also shown in FIG. 2).

Perforations 50 are formed through the casing 44 at the location of the hydrocarbon-bearing zone 42. The perforations 50 admit the liquid 24 and natural gas 26 from the hydrocarbon-bearing zone 42 into the casing chamber 48. The perforations 50 are conventionally located a few tens of feet above the well bottom 34. The volume within the casing chamber 48 beneath the perforations 40 is typically referred to as a catch basin or "rat hole." The well bottom 34 includes the catch basin.

Natural pressure from the hydrocarbon-bearing zone 42 causes the liquid 24 and natural gas 26 to flow from the zone 42 through the perforations 50 and into the casing chamber 48. The liquid 24 accumulates in the casing chamber 48 until a vertical column of the liquid extends above the perforations 50 within the casing 44. Generally speaking, the gas 26 enters the column of liquid from the perforations 50, bubbles to the top of the accumulated liquid column, and enters the casing chamber 48. As shown in FIG. 1, the column of liquid reaches a level represented at 52 which is established by the natural earth formation pressure. At that height, the hydrostatic head pressure from the column of liquid 24 counterbalances the natural earth formation pressure, and the flow of liquid and gas from the zone 42 into the well bottom 34 ceases because there is no pressure differential to move the liquid and gas into the well bottom 34. Under these conditions, the well 22 is said to die or choke off, because no further liquid or gas can be produced into the well because the hydrostatic pressure of the column of accumulated liquid counterbalances the natural earth formation pressure.

Until the level of accumulated liquid rises to the point where its hydrostatic head pressure counterbalances the natural earth formation pressure, natural gas flows from the zone 42 into the casing 44 and bubbles upward from the perforations 50 through the accumulated liquid column. If the level of accumulated liquid in the well bottom 34 is not above the level of the perforations 50, the natural gas 26 will enter the casing chamber 48 from the zone 42 without bubbling through the liquid. However when the accumulated liquid column reaches a sufficient height to choke off the well, the hydrostatic pressure from that column of liquid prevents the flow of natural gas into the casing chamber 48.

To prevent the well from dying and choking off, the level 52 of the accumulated liquid column must be kept low enough that its hydrostatic head pressure is less than the natural earth formation pressure. This is accomplished by removing the liquid from the well bottom 34 to reduce the height of the accumulated liquid column. The liquid is removed by pumping or lifting it out of the well 22.

Reducing the height level 52 of the liquid 24 reduces the amount of hydrostatic pressure created by the accumulated liquid, and thereby permits the natural earth formation pressure to remain effective to flow more liquid and gas into the well.

As the well continues to produce over its lifetime, the amount of natural earth formation pressure diminishes. It becomes more important to keep the height level 52 of the accumulated liquid 24 low enough so that the diminished formation pressure remains effective in moving the gas and liquid into the well. Moreover, as liquid 24 is removed from the well, a natural pressure transition throughout the zone 42 occurs where the natural earth formation pressure at the perforations 50 is somewhat less than the natural earth formation pressure at locations spaced radially outwardly from the perforations 50. This zone of slightly diminished natural earth formation pressure, shaped somewhat like a cone, results because the zone 42 has certain natural permeability and flow characteristics which inhibit instantaneous pressure equilibrium throughout the zone 42. Thus, as liquid is removed from the well bottom 34, there will be an effective reduction in natural earth formation pressure simply as a result of the removal of the liquids. The level 52 of liquid 24 must be maintained at a low enough level that its hydrostatic head pressure remains below this flowing bottom hole pressure from the earth formation.

To remove the liquid 24, the gas recovery apparatus 20 includes a string of production tubing 54 which is inserted into the casing chamber 48 and which extends from the surface 28 to the well bottom 34. The production tubing 54 is of a lesser diameter than the diameter of the casing 44, thereby causing the casing chamber 48 to assume an annular shape (FIG. 2) between the exterior of the production tubing 54 and the interior of the casing 44. The lower end of the production tubing 54 extends into the catch basin or well bottom 34 at or below the perforations 50. The lower end of the production tubing 54 is closed by a one-way valve 56 at the bottom end of the production tubing 54. The production tubing 54 circumscribes a production chamber 58 (FIG. 2) which is located within the interior of the production tubing 54.

The one-way valve 56 opens to allow liquid to pass from the casing chamber 48 into the production chamber 58, when pressure in the casing chamber 48 at the one-way valve 56 is greater than or equal to the pressure inside of the production tubing 54 at the one-way valve 56. However, when the pressure inside of the production tubing 54 at the one-way valve 56 is greater than the pressure in the casing chamber 48, the one-way valve 56 closes to prevent liquids within the production chamber 58 from flowing backwards through the valve 56 into the casing chamber 48. The one-way valve 56 is preferably one or more conventional standing valves. Two or more standing valves in tandem offer the advantage of redundancy which permits continuing operations even if one of the standing valves should fail.

A string of lift tubing 60 is inserted within the production tubing 54. The lift tubing 60 extends from the earth surface 28 and terminates at a lower end near the one-way valve 56, for example approximately a few feet above the bottom end of the production tubing 54. An open bottom end of the lift tubing 60 establishes a fluid communication path from the production chamber 58 to the interior of the lift tubing 60. The interior of the lift tubing 60 constitutes a lift chamber 62 through which the liquid and gas from the well bottom 34 flow upward to the earth surface 28. The lift tubing 60 causes the production chamber 58 to assume an annular configuration, while the lift chamber 62 is generally circular in cross-sectional size, as shown in FIG. 2.

Although shown in FIG. 2 as positioned concentrically, the production tubing 54 and the lift tubing 60 may not necessarily be centered about the axis of the casing 44. Moreover, the lift tubing 60 need not be positioned within the production tubing 54 along the entire depth of the well bore 38, so long as there is constant fluid communication between the lift chamber 62 and the production chamber 58, and so long as there is communication between the chambers 58 and 62 and the casing chamber 48 through the one-way valve 56 in the manner described herein.

The natural formation pressure from the hydrocarbon-bearing zone 42 causes liquid 24 in the casing chamber 48 to pass through the one-way valve 56 and enter the production chamber 58 and the lift chamber 62, when the chambers 58 and 62 experience a relatively lower pressure than is present in the well bottom 34 as a result of the natural earth formation pressure. The levels of the liquid 24 within the production chamber 58 and the lift chamber 62 increase until the levels of the liquid in the chambers 58 and 62 are approximately equal to the level of the liquid in the casing chamber 48, under initial starting conditions where the pressure in the casing chamber 48 is approximately the same as the pressure within the chambers 58 and 62. These initial starting conditions prevail before the compressor 32 begins to create pressure differentials between the chambers 48, 58 and 62 during the different phases of the recovery cycle of the present invention.

The casing 44, the production tubing 54 and the lift tubing 60 extend from the well bottom 34 to the wellhead 46 located at the earth surface 28. A cap 66 closes the top end of the casing 44 against the production tubing 54, thus closing the upper end of the casing chamber 48 at the wellhead 46. Ports 68 and 70 extend through the casing 44 to communicate with the closed upper end of the casing chamber 48 at the wellhead 46. A cap 72 closes the top end of the production tubing 54 against the lift tubing 60, thereby closing the upper end of the production chamber 58 at the wellhead 46. A port 74 extends through the production tubing 54 to communicate with the upper end of the production chamber 58 at the wellhead. A cap 76 closes the upper end of the lift tubing 60 at the wellhead 46. Ports 78 and 80 are formed through the lift tubing 60 to communicate with the upper end of the lift chamber 62 at the wellhead 46. The ports 68, 70, 74, 78 and 80 connect to conduits and valves which interconnect the casing chamber 48, the production chamber 58 and the lift chamber 62 to the compressor 32 and to the sales conduit 36.

Pressure sensors 82, 84 and 86 connect to the casing chamber 48, the production chamber 58 and the lift chamber 62 for the purpose of sensing the pressures within those chambers, respectively. A pressure sensor 88 is also connected to a conventional liquid-gas separator 89 which is connected to receive a flow of liquid and gas from the well bottom 34. The liquid-gas separator 89 separates the liquid from the gas, and delivers the gas to the sales conduit 36. The pressure sensor 88 senses the pressure within the liquid-gas separator 89, and that pressure is the same as the pressure within the sales conduit 36. The pressure sensors 82, 84, 86 and 88 supply individual signals indicative of the individual pressures that they sense to a system controller 92. The pressure signals supplied by the pressure sensors 82, 84, 86 and 88 are collectively referenced 90.

A flow sensor 83 is connected in series with the port 70 from the casing chamber 48. The flow sensor 83 measures the amount of natural gas, if any, which is volunteered by the well. The volunteered natural gas flows from the casing chamber 48, into the separator 89 and from there into the sales conduit 36. A flow sensor 85 is connected between the liquid-gas separator 89 and the sales conduit 36. The flow sensor 85 measures the amount of natural gas flowing from the well 22 and gas recovery apparatus 20 into the sales conduit 36. The flow sensors 83 and 85 supply individual signals representative of the flow of gas through them. Each flow sensor 83 and 85 supplies an individual flow signal representative of the volumetric gas flow through it, to the system controller 92. The individual flow signals from the flow sensors 83 and 85 are collectively referenced 91.

The compressor 32 includes a suction port 94, which is connected to a suction manifold 100, and a discharge port 98, which is connected to a discharge manifold 96. The compressor 32 operates in the conventional manner by creating relatively lower pressure gas at the suction port 94, compressing the gas received at the suction port 94, and delivering the compressed or relatively higher pressure gas through the discharge port 98. The compressor 32 thus creates a pressure differential between the relatively lower pressure gas at the suction port 94 and the relatively higher pressure compressed gas at the discharge port 98. The pressure differential created by the compressor 32 is used to create the phases of the gas recovery cycle of the gas recovery apparatus 20. The compressor 32 is sized to have a sufficient volumetric capacity, and to create sufficient pressure differentials, to perform the gas recovery cycle described below.

The suction manifold 100 and the discharge manifold 96 are preferably connected together by conventional start-up by-pass and swing check valves (not shown). The start-up bypass valve allows the compressor to be started without a load on it. The swing check valve is a one-way valve that opens if the pressure in the suction manifold 100 exceeds the pressure in the discharge manifold 96. Higher pressure in the suction manifold compared to the pressure in the discharge manifold may occur momentarily during transitions between the various phases of the gas recovery cycle.

Motor or control valves 102, 104 and 106 connect the suction manifold 100 through the ports 68, 74 and 80 to the casing chamber 48, the production chamber 58 and the lift chamber 62, respectively. Motor or control valves 108 and 109 connect the discharge manifold 96 through the ports 74 and 68 to the production chamber 58 and the casing chamber 48, respectively. Motor or control valves 110 and 112 connect the casing chamber 48 and the lift chamber 62 through the ports 70 and 78 to the sales conduit 36, respectively. Motor or control valves 114 and 116 connect the suction manifold 100 and the discharge manifold 96 to the sales conduit 36, respectively.

The control valves 102, 104, 106, 108, 109, 110, 112, 114 and 116 are opened and closed in response to valve control signals applied to each valve by the system controller 92. The valve control signals are collectively referenced 118 in FIG. 1. The controller 92 preferably includes a microprocessor-based computer or microcontroller which executes a program to deliver the valve control signals 118 to the control valves 102, 104, 106,108,109, 110, 112, 114 and 116 under the circumstances described below to cause the gas recovery apparatus 20 to execute the gas recovery cycle. The controller 92 establishes the opened and closed states of the control valves in accordance with its own programmed functionality, by timing phases involved with the phases of the gas recovery cycle, and/or by responding to the pressure signals 90 and the flow signals 91 during the phases of the gas recovery cycle, among other things. Although shown separately as control valves in FIGS. 1 and 4–7 for purposes of simplification of explanation, the flow conditions and phases described below can be achieved by other types of valve devices, such as one-way check valves, pressure regulators and the like used in combination with a lesser number of control valves.

The phases of the gas recovery cycle are created when the system controller 92 controls the opened and closed states of the control valves to cause the compressor 32 to create pressure conditions within the chambers 48, 58 and 62. These pressure conditions, described in greater detail below, lift liquid through the lift tubing 60 to remove accumulated liquid 24 in the well bottom 34 and thereby control the level 52 of the liquid 24, to keep the well producing natural gas 26. The gas recovery apparatus 20 offers the advantage of removing the liquid to control the liquid level even in relatively deep wells 22 and under conditions of diminished natural earth formation pressure.

The structure and equipment of the gas recovery apparatus 20 and the characteristics of the well 22 are essentially the same as those described in the above-identified U.S. patent. However, the present gas recovery apparatus 20 is operated differently, resulting in a new and improved gas recovery cycle 120, shown in FIG. 3. The gas recovery cycle 120 includes a three chamber evacuation phase 128, a liquid reduction phase 130, a liquid capture phase 122, a liquid removal phase 124 and a production phase 126. Executing these five phases in sequence creates the gas recovery cycle 120. By executing these five phases 128, 130, 122, 124 and 126, accumulated liquid 24 at the well bottom 34 is removed more effectively and efficiently, allowing natural gas 26 to be produced in greater volumes and with greater efficiency.

The inclusion of the liquid reduction phase 130 in the natural gas recovery cycle 120 is the primary improvement of the present invention, compared to the invention described in the above-identified U.S. patent. The three chamber evacuation phase 128, the liquid capture phase 122, the liquid removal phase 124 and the production phase 126 are essentially the same as comparably-named phases described in the above-identified U.S. Patent. However, because of the improvements provided by including the liquid reduction phase 130 in the gas recovery cycle 120, the time duration of the entire cycle 120, or the time durations of each of the phases of the cycle 120, or the proportions of the cycle 120 consumed by each of the different phases, may be adjusted to take maximum advantage of the improvements from the present invention. Including the liquid reduction phase 130 with the three chamber evacuation phase 128 in the gas recovery cycle 120 is particularly important at the end of the well's lifetime, because the well can still be worked economically under circumstances which might otherwise make working the well impractical.

Figure 4:
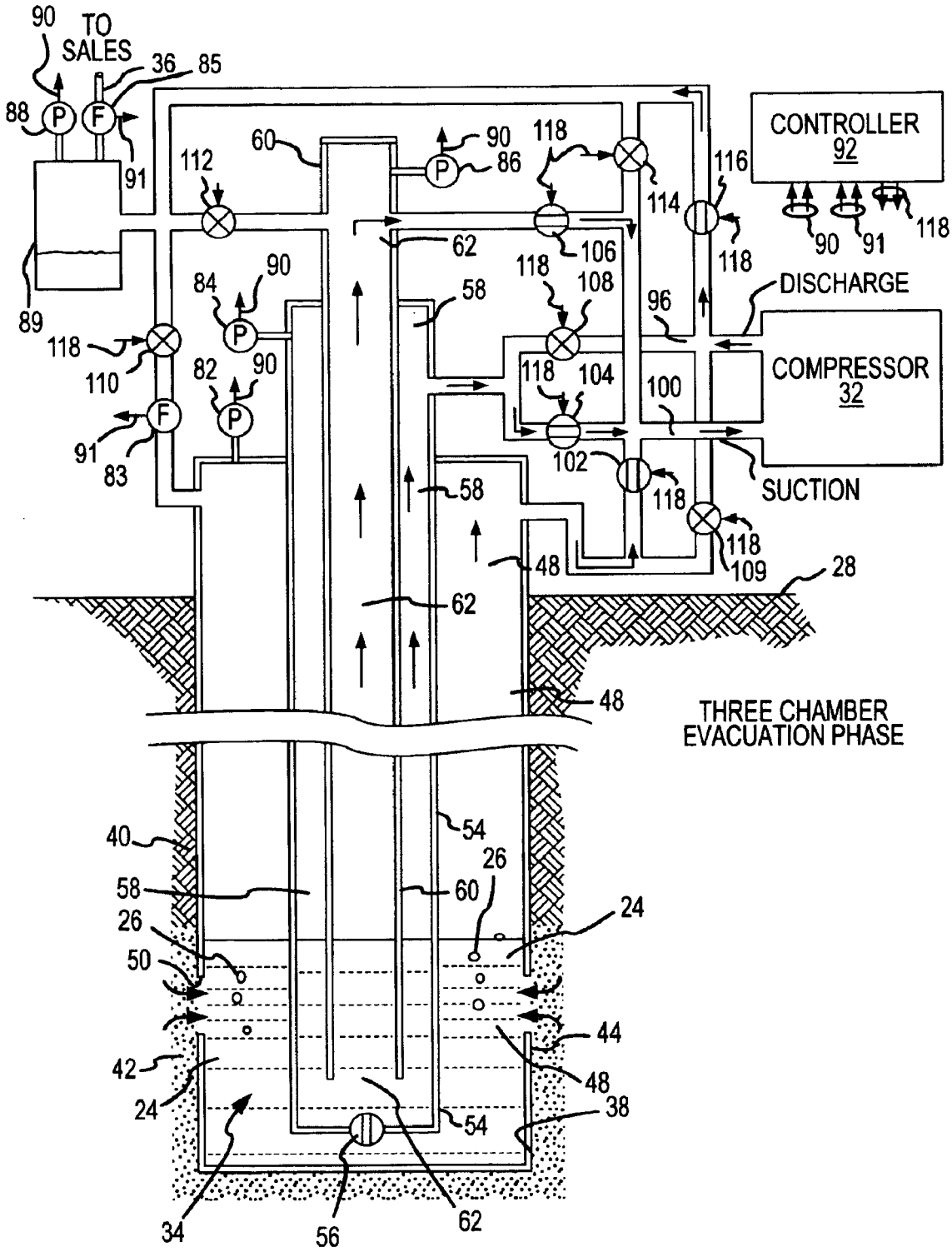
FIG. 4 is a simplified schematic and block diagram similar to FIG. 1 illustrating performance of the three chamber evacuation phase of the gas recovery cycle shown in FIG. 3.

Details of the three chamber evacuation phase 128 are understood by reference to FIG. 4, which shows the operative state of the gas recovery apparatus 20 when performing the three chamber evacuation phase 128. During the three chamber evacuation phase 128, relatively low or suction pressure from the compressor 32 is applied to the casing chamber 48, the production chamber 58 and the lift chamber 62. The control valves 102, 104 and 106 are opened by the controller 92, causing the lift chamber 62, the production chamber 58 and the casing chamber 48 to be connected to the suction manifold 100 of the compressor 32, thereby subjecting all three chambers 48, 58 and 62 to low or suction pressure. The control valve 116 is also opened, connecting the discharge manifold 96 to the sales conduit 36 through the separator 89. The control valves 108, 109, 110, 112 and 114 are closed by the controller 92. Depending upon the circumstances of the well, the control valve 110 may be opened to allow volunteer gas to flow directly into the separator 89 and the sales conduit 36, although normally the control valve 110 will not be opened.

With the control valves in this described state, the natural gas is evacuated from the chambers 48, 58 and 62, is compressed by the compressor 32 and is delivered to the sales conduit 36. Compressing the natural gas before delivering it through the opened control valve 116 to the sales conduit assures that there is sufficient pressure to flow the natural gas directly into the sales conduit, even under circumstances where the pressure within the sales conduit is relatively high.

The reduced pressure within the casing chamber 48 creates a greater pressure differential than would otherwise be created by the formation pressure itself. This greater pressure differential augments the natural earth formation pressure and causes the liquid in gas within the zone 42 to flow more readily through the perforations 50 and into the well bottom 34, thereby decreasing the amount of time required to produce specific volumes of gas and liquid. Although the liquid reduction phase 130 (FIG. 5), the liquid removal phase 124 (FIG. 7) and the production phase 126 (FIG. 8) also apply relatively low pressure through the casing chamber 48 to the hydrocarbon zone 42 and thereby increase the flow of liquid and gas into the well bottom 34, the three chamber evacuation phase 128 is primarily responsible for producing the substantial majority of the gas and liquid during the gas recovery cycle 120.

The natural gas is produced primarily out of the casing chamber 48, as a result of the low or suction pressure of the compressor 32 lifting the gas to the earth surface as gas enters the casing chamber 48 from the hydrocarbon producing zone 42, and as a result of any effective natural earth formation pressure forcing the natural gas into the casing chamber 48. The gas production is directly up the casing chamber 48, through the compressor 32 and into the sales conduit 36. The production path directly up the casing chamber 48 is the shortest path for recovering the gas up the well, thereby reducing the flowing friction losses and increasing the efficiency and producing the natural gas. In addition, the cross-sectional size of the casing chamber 48 is relatively large, and this relatively large cross-sectional size also diminishes flowing friction losses. Therefore, producing natural gas up the casing chamber 48 offers the shortest and largest cross-sectional size flow path and results in more efficient gas production because of lower flowing friction losses. The beneficial effect of the natural formation pressure in producing the natural gas directly up the casing chamber 48 is not diminished, which also contributes to gas production efficiency.

The substantially equal and relatively low pressures within the casing, production and lift chambers 48, 58 and 62 created during the three chamber evacuation phase 128 open the one-way valve 56, because the pressure in the production chamber 58 is no greater than the pressure in the casing chamber 48. The open valve 56 allows liquid from the bottom of the casing chamber 48 to move into the bottom of the production chamber 58 and the lift chamber 62. Moving some of the accumulated liquid into the production chamber 58 and the lift chamber 62 during the three chamber evacuation phase 128 has the net effect of eliminating some of the accumulated liquid within the casing chamber 48. Reducing the accumulated volume of liquid in the casing chamber 48 diminishes the height of the liquid column, reduces hydrostatic pressure within the casing chamber 48, and extends the time period during which the liquid and gas flows into the well before the liquid accumulates sufficiently to diminish the flow rate into the well. This has the effect of extending the proportion of the gas recovery cycle 120 during which gas and liquid flows into the well.

The three chamber evacuation phase 128 should not continue for such a long time to accumulate so much liquid to make the compressor 32 incapable of delivering enough pressure to lift the accumulated liquid or to the point where the well is totally loaded up with liquid and choked off. Furthermore, the liquid should not accumulate in the casing chamber 48 to such an extent that the production phase 126 (FIG. 8) must extend for a relatively long time period in order to lift the greater amount of accumulated fluid to the surface.

The pressure of the sales conduit 36 is not a limiting factor on the ability to deliver the produced natural gas into the sales conduit. Some gas pipelines or sales conduits have relatively high pressures, making it difficult to deliver the gas directly from the well to the sales conduit, particularly under circumstances where the earth formation pressure in the well is already diminished at the end of a well's lifetime. By connecting all three chambers 48, 58 and 62 through the open valves 102, 104 and 106, respectively, to the suction manifold 100 of the compressor 32, the compressed gas supplied at the discharge manifold 96 through the open control valve 116 is sufficient to overcome the pressure within the sales conduit 36. Thus, the use of the three chamber evacuation phase 128 also assures that the pressure of the sales conduit 36 will not be a limiting factor on the ability to deliver the recovered natural gas.

If the natural earth formation pressure is sufficient to volunteer natural gas within the casing chamber 48 at a pressure sufficient to directly enter the sales conduit 36, the valve 110 may be opened to deliver that volunteered gas directly to the sales conduit in addition to delivering the compressed gas from the compressor 32 through the opened control valve 116.

The duration of the three chamber evacuation phase 128 is established by monitoring the flow volume through the flow sensor 85 and the pressure in the casing chamber 48, the production chamber 58 and the lift chamber 62. A diminished flow through the flow sensor 85 and an decreased pressure in the chambers 48, 58 and 62, compared to the flow and pressure levels which existed at the commencement of the three chamber evacuation phase 128, indicate an increasing level of liquid at the well bottom 34. Monitoring these conditions establishes the duration of the three chamber evacuation phase, and thereby limits the amount of liquid accumulated at the well bottom during the three chamber evacuation phase. In addition or as an alternative, the time duration of the three chamber evacuation phase 128 may be timed by the controller 92. Upon terminating the three chamber evacuation phase 128, the controller 92 changes the states of various control valves to commence executing the liquid reduction phase 130 shown in FIGS. 3 and 5.

Figure 5:
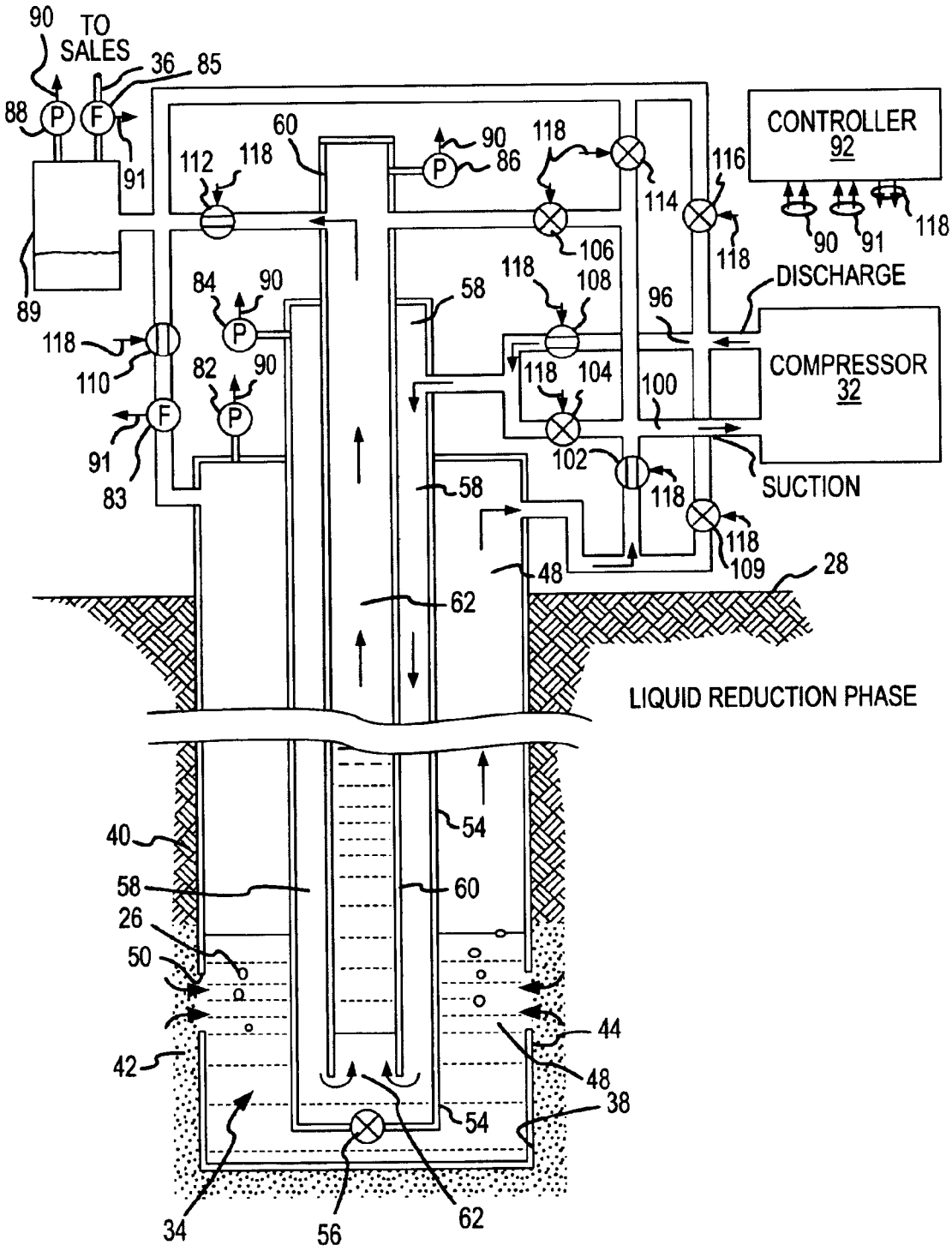
FIG. 5 is a simplified schematic and block diagram similar to FIG. 1 illustrating performance of the liquid reduction phase of the gas recovery cycle shown in FIG. 3.

Details of the liquid reduction phase 130 are understood by reference to FIG. 5, which shows the operative state of the gas recovery apparatus 20 when performing the liquid reduction phase 130. During the liquid reduction phase 130, the liquid which accumulated within the production chamber 58 and the lift chamber 62 during the preceding three chamber evacuation phase is removed to the earth surface. To execute the liquid reduction phase 130, relatively low or suction pressure from the compressor 32 is applied to the casing chamber 48, and relatively high pressure from the compressor 32 is applied to the production chamber 58. The control valves 102, 108 and 112 are opened by the controller 92, causing the casing chamber 48 to be connected to suction manifold 100 of the compressor 32, the production chamber 58 to be connected to the discharge manifold 96 of the compressor 32, and the lift chamber 32 to be connected to the sales conduit 36 through the separator 89, respectively. Depending upon the pressure from the volunteered gas in the casing chamber 48, the control valve 110 may also be opened by the controller 92 to allow gas from the casing chamber 48 to flow directly into the separator 89 in the sales conduit 36.

With the control valves in this described state during the liquid reduction phase 130, the compressor creates a relatively low pressure in the casing chamber 48 and a relatively high pressure in the production chamber 58. The relatively high pressure in the production chamber 58 and the relatively low pressure in the casing chamber 48 cause the one-way valve 56 to close, which traps the liquid accumulated within the production chamber 58 during the preceding three chamber evacuation phase and prevents liquid or gas from moving out of the production chamber 58 and into the casing chamber 48. These applied pressures hold the one-way valve 56 closed during the liquid reduction phase 130.

The relatively low pressure in the lift chamber 62 and relatively high pressure in the production chamber 58 push the liquid accumulated in the bottom of the production chamber 58 into the lift chamber 62 and move that liquid up the lift chamber 62, through the opened valve 112 and into the separator 89. The gas separates from the liquid in the separator 89, and the gas flows to the sales conduit 36. Thus, the gas which is used to lift the liquid up the lift chamber 62 is recovered, although this gas recovery occurs at some efficiency loss due to the lengthy and relatively small cross-sectional size of the path that the gas must traverse down the production chamber 58 and up the lift chamber 62. Nevertheless, some gas production does occur during the liquid reduction phase 130.

While the liquid reduction phase 130 is discussed as being executed from applying a relatively high pressure in the production chamber 58 and a relatively low pressure in the lift chamber 62 to lift the liquid through the lift chamber 62, reversing the application of pressure in the chambers 58 and 62 can accomplish similar results. Of course, to apply the pressure in this reverse manner will also require changing the opened and close to states of other valves associated with the chambers 58 and 62.

The gas flow continues in the described manner during the liquid reduction phase 130, until signals 90 from the pressure sensor 84 and 86 are interpreted by the controller 92 to indicate that substantially all of the liquid has been transferred up the lift chamber 62. Alternatively, the length of the liquid reduction phase 130 may be timed by timer of the controller 92. Upon terminating the liquid reduction phase 130, the controller 92 changes the states of various control valves to commence executing the liquid capture phase 122 shown in FIGS. 3 and 6.

Figure 6:
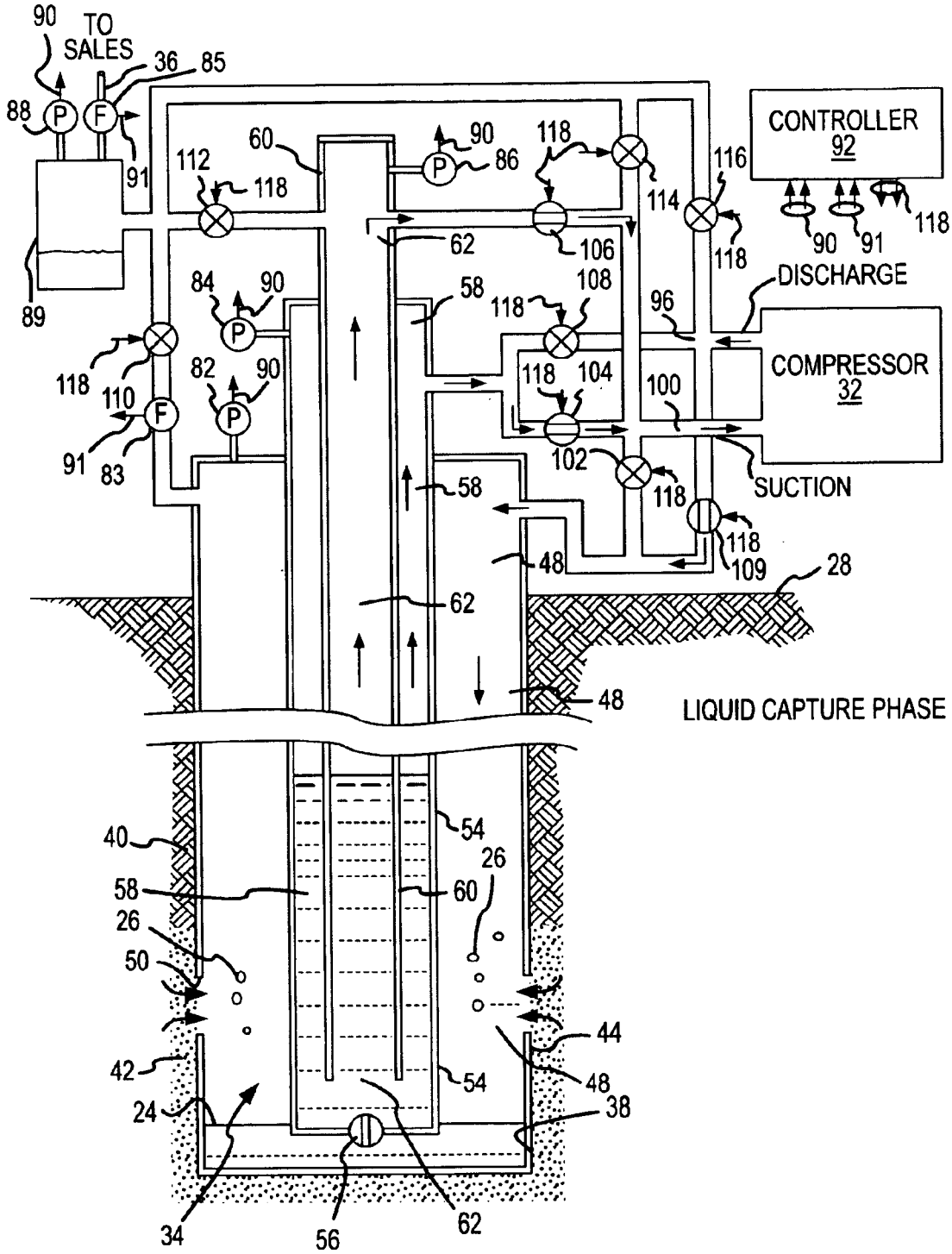
FIG. 6 is a simplified schematic and block diagram similar to FIG. 1 illustrating performance of the liquid capture phase of the gas recovery cycle shown in FIG. 3.

Details of the liquid capture phase 122 are understood by reference to FIG. 6, which shows the operative state of the gas recovery apparatus 20 when performing the liquid capture phase 122. During the liquid capture phase 122, relatively low or suction pressure is applied to the production chamber 58 and the lift chamber 62, and relatively high pressure is applied to the casing chamber 48. The control valves 104, 106 and 109 are opened by the controller 92, causing the lift chamber 62 and the production chamber 58 to be connected to the suction manifold 100 of the compressor 32 and causing the casing chamber 48 to be connected to the discharge manifold 96. The control valves 102, 108, 112, 114 and 116 are closed by the controller 92.

The compressor creates a relatively low or suction pressure within the production chamber 58 and the lift chamber 62, and creates a relatively high pressure in the casing chamber 48. The relatively low pressure within the production and lift chambers 58 and 62 is below the hydrostatic head pressure of the accumulated column of liquid 24 at the well bottom 34. The relatively high pressure in the casing chamber 48 may slightly increase the pressure at the well bottom 34 beyond that pressure created by the head of the accumulated liquid.

The control valve 110 can be partially opened and used as a pressure regulation valve to regulate the amount of relatively high pressure within the casing chamber 48. Gas in excess of what is needed to maintain a desired high pressure within the casing chamber 48 is conducted through the partially opened control valve 110 and delivered to the sales conduit 36. Regulating the partially opened condition of the control valve 110 permits the pressure within the casing chamber 48 to remain relatively high while still permitting some gas to be produced under those circumstances where the well is capable of doing so.

The reduced pressure within the production and lift chambers 58 and 62 creates a pressure differential relative to the higher pressure in the casing chamber 48, and that pressure differential opens the one-way valve 56 to admit the liquid from the casing chamber 48 into the production and lift chambers 58 and 62. The liquid from the casing chamber 48 has been previously accumulated during the preceding three chamber evacuation and liquid reduction phases, but this liquid was not lifted during the liquid reduction phase 130 because the one-way valve 56 was closed to prevent this accumulated liquid from entering the production chamber 58 during the liquid reduction phase 130.

The one-way valve 56 remains open until substantially all of the liquid above the one-way valve 56 has been transferred into the bottom of the production chamber 58 and lift chamber 62. The production chamber 58 and the lift chamber 62 are available to accept this liquid from the casing chamber 48, as a result of having been cleared of liquid during the previously executed the liquid reduction phase 130 (FIG. 5). Thus, including the liquid reduction phase 130 in the gas recovery cycle 120 makes it possible to accept and lift liquid twice during each gas production cycle 20, and also makes it possible to more effectively eliminate liquid from the well bottom to extend the time period for the recovery of natural gas. The remaining liquid in the casing chamber 48 is loaded into the production chamber 58. This liquid will thereafter be lifted to the earth surface during the subsequently executed liquid removal phase 124 (FIG. 7) and the production phase 126 (FIG. 8). The casing chamber 48 is essentially dried out of liquid above the one-way valve 56. Eliminating essentially all of the liquid in the casing chamber 48 above the one-way valve 56 assures that the maximum amount of liquid can be accumulated in the well bottom during the three chamber evacuation phase 128, thereby extending the opportunity to recover natural gas during each gas recovery cycle 120.

During the liquid capture phase 122, the relatively high pressure which is applied into the casing chamber 48 from the compressor 32 has the effect of countering or diminishing the natural earth formation pressure. Reducing or blocking the effect of the natural earth formation pressure diminishes the amount of natural gas and liquid which flows from the hydrocarbons-bearing zone 52 through the perforations 50 and into the bottom of the well. Gas production is diminished or temporarily suspended under these conditions. Some amount of the liquid which has risen to a level above the perforations 50 may even be forced back into the hydrocarbons-bearing zone 42. It is therefore important that as much liquid as possible be recovered during each gas recovery cycle, without leaving any more residual liquid behind than is necessary. The liquid reduction phase 130 assists in this regard by increasing the amount of liquid which may be lifted during each natural gas production cycle 120 and by diminishing the time duration of the liquid capture phase 122. Eliminating the time duration of the liquid capture phase also limits the amount of time when the casing chamber 48 is pressurized, thereby reducing the amount of liquid that may be pushed back into the zone 42.

In some wells with relatively high natural earth formation pressures and gas flow rates, it may not be necessary to apply the relatively high pressure from the compressor 32 to the casing chamber 48 during the liquid capture phase 122. Instead, the well may volunteer or naturally produce gas at a sufficient natural pressure within the casing chamber 48 so that an adequate pressure differential is created at the one-way valve 56 to move the accumulated liquid from the casing chamber 48 through the valve 56 and into the production chamber 58. When this is the case, the control valve 110 is opened slightly so as to maintain a preset pressure in the casing chamber 48. The compressed natural gas delivered through the open control valve 109 flows into the casing chamber 48 and then through the opened valve 110 and through the separator 89 into the sales conduit 36. Thus, under these circumstances, the gas removed from the production chamber 58 and the lift chamber 62 is conducted through the compressor 32, and the opened valves 109 and 110 into the sales conduit 36. Another configuration would be to leave valves 109 and 110 closed and open valve 116 to deliver gas to the sales conduit 36. This will allow pressure in the casing chamber 48 to build at a rate determined only by the gas contributed from the formation.

Figure 3:
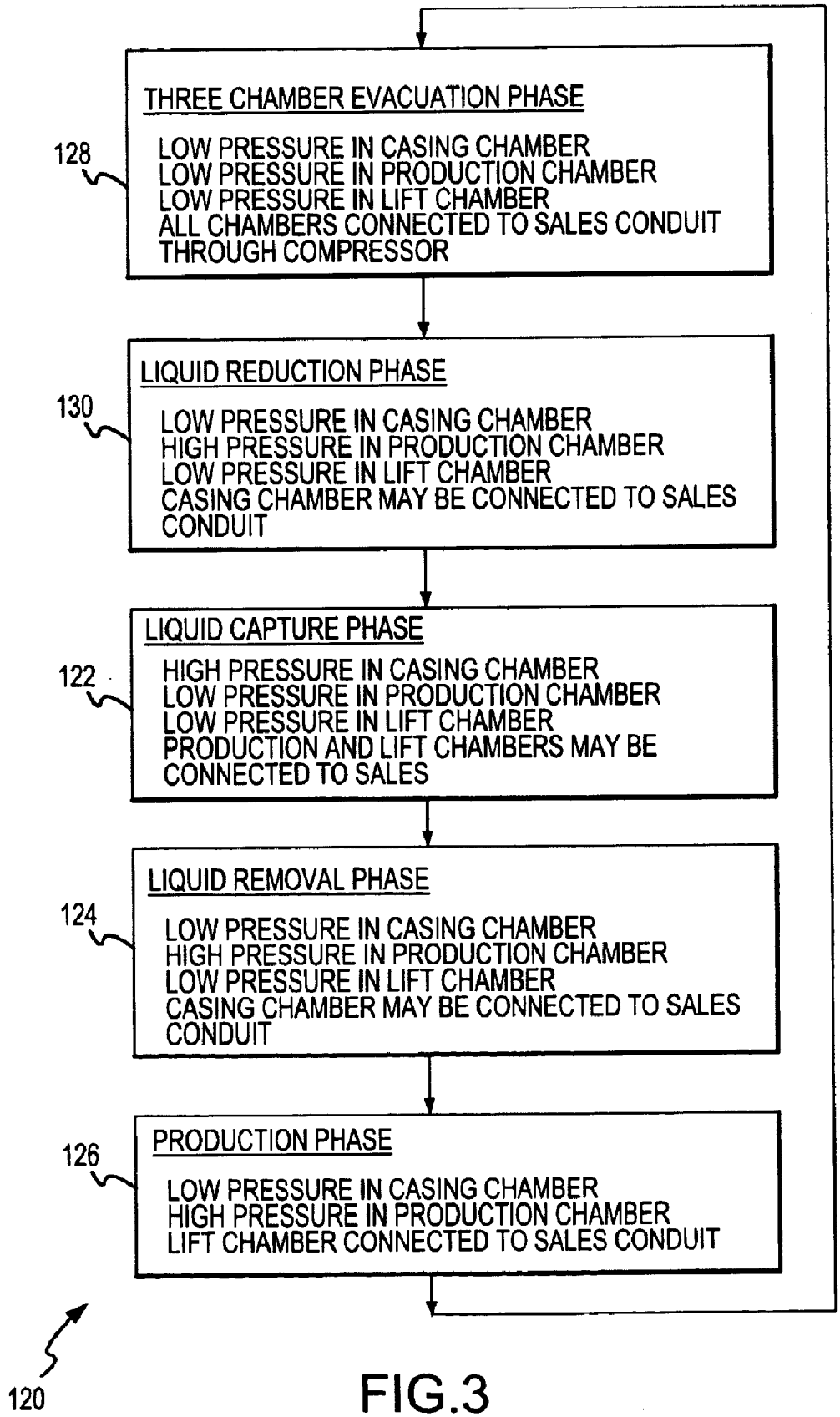
FIG. 3 is a flowchart of a gas recovery cycle of the gas recovery apparatus shown in FIG. 1, and a method of the present invention, comprising a three chamber evacuation phase, a liquid reduction phase, a liquid capture phase, a liquid removal phase and a production phase.
Figure 7:
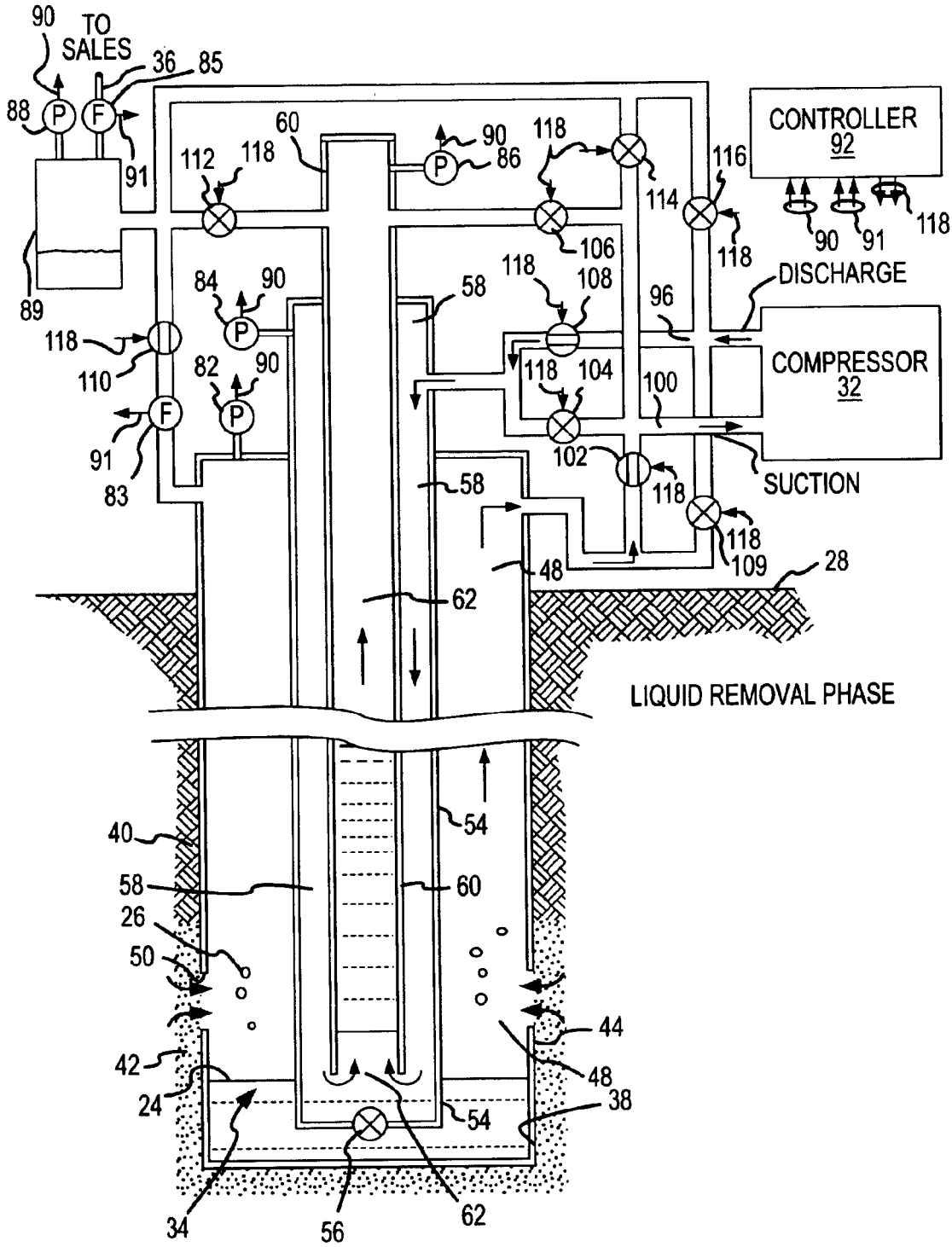
FIG. 7 is a simplified schematic and block diagram similar to FIG. 1 illustrating performance of the liquid removal phase of the gas recovery cycle shown in FIG. 3.
Figure 8:
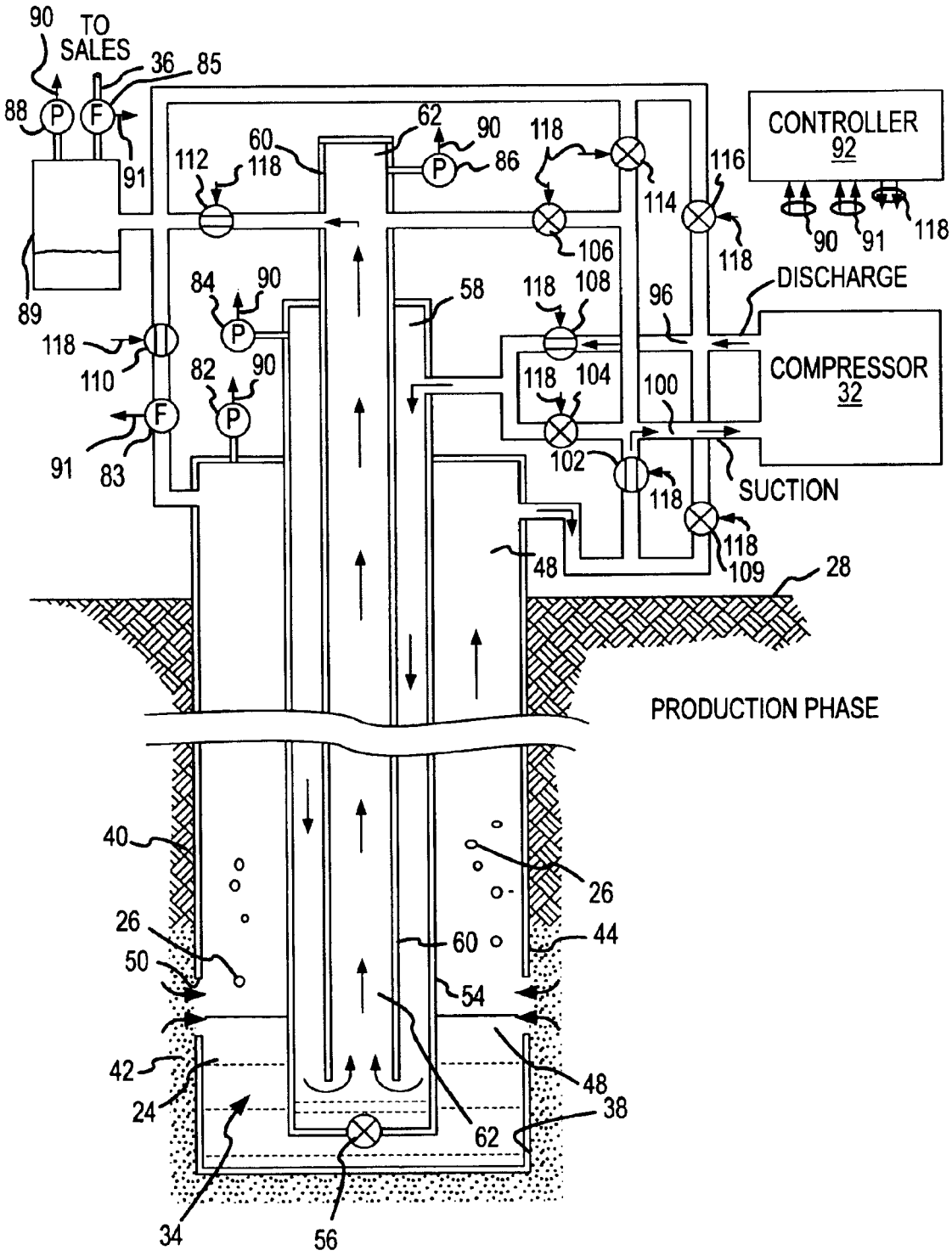
FIG. 8 is a simplified schematic and block diagram similar to FIG. 1 illustrating performance of the production phase of the gas recovery cycle shown in FIG. 3.

Once the pressure sensors 84 and 86 have supplied signals indicating that the pressure within the production chamber 58 has increased to a predetermined level signifying that the liquid has entered the production chamber 58, or once a predetermined time period for performing the liquid capture phase 122 has elapsed, the controller 92 changes the states of the control valves to commence executing the liquid removal phase 124 shown in FIGS. 3 and 7.

Details of the liquid removal phase 124 are understood by reference to FIG. 7, which shows the operative state of the gas recovery apparatus 20 when performing a beginning part of the liquid removal phase 124. During the liquid removal phase 124, the control valves 102 and 108 are opened, and the valves 104, 106, 109, 110, 112, 114 and 116 are closed, by the controller 92 delivering the control signals 118 to these valves. With the valves in these states, the casing chamber 48 is connected to the relatively low or suction pressure from the suction manifold 100 of the compressor 32, and the production chamber 58 is connected to the relatively high pressure from the discharge manifold 96 of the compressor 32. The relatively low pressure within the lift chamber 62 which was established in the previous liquid capture phase 122 (FIG. 6) is trapped within the lift chamber 62 by the closure of valve 106.

The relatively low pressure created in the casing chamber 48 by the suction of the compressor 32 immediately starts to assist the natural earth formation pressure in moving the liquids and natural gas from the zone 42 into the well. The gas removed from the casing chamber 48 is compressed by the compressor 32 and is delivered into the production chamber 58. The gas removed from the casing chamber 48 is used to lift the liquid. Any excess gas volunteered by the well beyond that required for compression and injection into the production chamber 58 may be delivered to the sales conduit 36 by opening the control valves 110 and/or 116.

The relatively high pressure from the discharge of the compressor 32 creates a relatively higher pressure in the production chamber 58, which closes the one-way valve 56, thereby confining the high pressure and the accumulated liquid within the production chamber 58. The relatively low pressure in the lift chamber 62 from the liquid capture phase 122 (FIG. 6), which has been trapped by closing the valve 106, is separated from the relatively higher pressure in the production chamber 58 by the liquid at the bottom of the production tubing 54 above the one-way valve 56. The relatively higher pressure in the production chamber 58 and the trapped relatively lower pressure in the lift chamber 62 move the liquid from the bottom of the production chamber 58 into the lift chamber 62, thus filling the lift chamber 62 with the liquid captured during the preceding liquid capture phase 122 (FIG. 6).

The displacement of the liquid up and into the lift chamber 62 causes gas to flow around the lower terminal end of the lift tubing 60 and to begin bubbling up through the fluid column of liquid located in the bottom end of the lift chamber 62. The gas flow through the liquid at the bottom end of the lift chamber 62 causes the pressure in the lift chamber 62 to increase (the trapped relatively lower pressure decreases), and this increase in pressure is sensed by the pressure sensor 86. The increase in pressure in the lift chamber 62 indicates that the liquid from the bottom of the production chamber has entered the lift chamber 62. The controller 92 recognizes a predetermined increase of pressure within the lift chamber 62 as signifying that the liquid from the bottom of the production chamber has been loaded into the lift chamber. At this point the end part of the liquid removal phase 124 begins. The state of the control valves in the end part of the liquid removal phase 124 are the same as those during the production phase 126, shown in FIG. 8. The controller 92 opens the valve 112, and the relatively high pressure within the production chamber 58 pushes the column of liquid up the lift chamber 62.

The liquid lifted up the lift chamber 62 and the pressurized natural gas which pushes the liquid up the lift chamber 62 are delivered through the opened control valve 112 into the gas-liquid separator 89. Within the separator 89, the liquid falls to the bottom while the gas flows through the flow sensor 85 to the sales conduit 36. The separator 89 thereby assures that the liquid from the well will not be delivered to the sales conduit 36, and permits the natural gas used to push the liquid up the lift chamber 62 to be delivered to the sales conduit 36. The liquid within the separator 89 is periodically removed.

The duration of the liquid removal phase 124 continues until the liquid in the lift tubing 62 has been delivered into the separator 89. This condition is sensed when the pressure sensor 86 supplies a signal 90 indicating that liquid has cleared from the lift tubing 60 and the flow sensor 85 signals a significant increase in the passage of gas into the sales conduit 36. Alternatively, the liquid removal phase 124 may be continued for a predetermined amount of time.

Details of the production phase 126 are understood by reference to FIG. 8, which shows the operative state of the gas recovery apparatus 20 when performing the production phase 26. The production phase begins after the liquid has been lifted to the earth surface and has been delivered into the separator 89. The valve 112 has been opened by the controller 92 during the preceding liquid removal phase 124, and the control valve 106 remains closed, just as in the previous liquid removal phase. In essence, all of the valves remain in the same state in the production phase 126 as existed at the end part of the liquid removal phase 124. In this regard, the production phase 126 may be considered as an extension of the liquid removal phase 124, or alternatively, the production phase 126 may be considered as beginning at the end part of the previously-described liquid removal phase 124 when the controller 92 has recognized from the pressure signals 90 from the sensors 84 and 86 that the substantial majority of the liquid has been transferred up the lift chamber 62 and out of the well. The point at which the previous liquid removal phase 124 terminates and the present production phase 126 commences is therefore not specific. In the context of the present invention, the production phase 126 need only continue for so long as necessary to lift any residual liquid up the lift chamber 62 and out of the well. Indeed, the production phase 126 as presently discussed in conjunction with FIG. 8 may be eliminated altogether, provided that the functionality associated with FIG. 8 is part of the liquid removal phase 124 discussed in conjunction with FIG. 7.

Once the production chamber 58 and lift chamber 62 are essentially free of liquid, a gas flow path, unimpeded by liquid, extends from the casing chamber 48, through the compressor 32, into the production chamber 58 and up the lift chamber 62 into the sales conduit 36. This flow path allows natural gas from the casing chamber 48 to be produced and delivered to the sales conduit 36, although the flow path for doing so requires passage up the well in the casing chamber 48, down the production chamber 58 and up the lift chamber 62 to the sales conduit. Circulating gas through the production chamber 58 and up the lift chamber 62 is also effective to lift any residual liquids in the interior of the production chamber 58 and lift chamber 62 thereby more effectively clearing the liquids that were captured during the liquid capture phase 122 (FIG. 6). Any gas volunteered by the well during the production phase is transferred from the casing chamber 48 directly to the sales conduit 36 through the opened control valve 110. Again, whether the control valve 110 is opened during the production phase depends on the flow conditions and circumstances of the well.

The production phase 126 ends after the sensed pressure in the production chamber 58 drops to a predetermined pressure level which indicates that the flow path through the production chamber 58 and the lift chamber 62 is essentially free of liquid. Alternatively, the controller 92 may terminate the production phase 126 after a predetermined time for the production phase 126 has elapsed.

At the conclusion of the production phase 126 (FIG. 8), which may also be at the conclusion of the end part of the liquid removal phase 124 (FIG. 7) as described above, the controller 92 transitions the state of the control valves back to the new three chamber evacuation phase 128 (FIGS. 3 and 5) to commence the next subsequent gas recovery cycle 120.

The inclusion of the liquid reduction phase 130 in the gas recovery cycle 120 achieves a number of improvements and advantages. The liquid reduction phase 130 improves the efficiency of the gas recovery cycle 120 by removing more liquid during each gas recovery cycle 120. The increase in efficiency is achieved by removing the liquid from the production chamber 58 and the lift chamber 62 during the liquid reduction phase 130, thereby making this empty volume available to receive more liquid from the casing chamber 48 during subsequent phases of the cycle 120.

Although the present invention may be advantageously applied in different types of wells, using the three chamber evacuation phase 128 in the cycle 120 is particularly advantageous in improving the efficiency and maintaining the productivity of relatively deep wells having relatively low natural earth formation pressures and which produce liquid at a relatively low rate. The relatively low pressure from the compressor 32 is applied to the casing chamber 48 and augments the relatively low natural formation pressure to cause gas and liquid to flow into the well to a greater extent than would otherwise occur. The relatively low production rate of liquid allows the three chamber evacuation phase 128 to continue for a sizable portion of the gas recovery cycle 120, before the amount of accumulated liquid builds up to the point where it diminishes gas recovery. While doing so, the gas is produced efficiently directly up the casing chamber in a direct flow path that offers relatively large cross-sectional size and the shortest distance from the well bottom to the earth surface, thereby achieving gas production with the lowest possible flowing friction losses. It is therefore desirable to maximize the duration of the three chamber evacuation phase, and to use the three chamber evacuation phase as the primary phase for gas production and not the production phase. By doing so, the gas is more efficiently produced without forcing gas through a relatively lengthy and small cross-sectionally sized flow path from the earth surface down the production chamber 58 to the well bottom and then back up the lift chamber 62 to both remove the liquid and produce the gas. Such a lengthy and circuitous flow path may extend several miles and has considerable flowing friction losses which diminish the productivity efficiency. Therefore, compared to the invention described in the above-identified U.S. patent, the present invention utilizes the liquid reduction phase 130 to maximize the time duration and gas productivity of the three chamber evacuation phase 128 while diminishing the amount of time and inefficiency associated with lifting the accumulated liquid from the well bottom and producing gas through the same path.

Using the liquid reduction phase 130 reduces the proportion of each gas recovery cycle 120 which is committed to producing gas through the high friction-loss flow path. By removing the liquid twice during each cycle, gas can be produced directly up the lesser frictional path casing chamber during a larger proportion of the gas recovery cycle, thereby reducing flowing friction losses and increasing production efficiency. Moreover, it is possible to lift the lesser amounts of liquid from greater depths. By lifting the liquid twice during each gas recovery cycle, the liquid does not accumulate to the point where the compressor has difficulty in lifting the liquid or a very lengthy portion of the gas recovery cycle is consumed by lifting the liquid.

Moreover, by lifting the liquid twice during each cycle 120, substantially all of the liquid from the casing chamber 48 will be removed during each gas recovery cycle 120, leaving no residual liquid in the casing chamber 48. Removing substantially all of the removable liquid assures that no slight residual amount of liquid will slowly accumulate over a number of subsequent natural gas recovery cycles 120 to the point that the accumulated residual liquid diminishes or chokes off gas production.

Additionally, the liquid removal phase 124 and the production phase 126 are required to lift only that liquid accumulated in the casing chamber 48 during the three chamber evacuation phase 128 and the liquid reduction phase 130, rather than all of the liquid accumulated in the well bottom. Less effort and less capacity is required from the compressor 32. The amount of liquid accepted for removal from the casing chamber 48 is not so much as to overwhelm the capacity for lifting the liquid during each cycle, even in relatively deep wells. Alternatively, more liquid in the well bottom can be allowed to accumulate since the compressor 32 will not have to create sufficient gas pressure to lift the amount of liquid at one time during each gas recovery cycle, as is the case in the invention described in the above-identified U.S. patent.

Also, because less liquid is being lifted during the subsequent liquid removal and production phases 124 and 126, these phases may be more quickly executed thereby allowing the gas recovery cycle 120 to return more rapidly to the three chamber evacuation phase 128 where the bulk of the natural gas is produced. Alternatively, the time duration of the three chamber evacuation phase 128 can be extended during each recovery cycle 120 to produce more gas. Since the three chamber evacuation phase 128 is the portion of the gas recovery cycle 120 during which the most gas is recovered from the well, it is beneficial to extend the three chamber evacuation phase 128 for as long as possible.

Furthermore, the liquid which is transferred into the production chamber 58 and lift chamber 62 during the three chamber evacuation phase 128 reduces the time duration of the liquid capture phase 122, because the liquid reduction phase 130 results in vacating the bottom of the production chamber 58 and the lift chamber 62 so that the liquid remaining at the bottom of the casing chamber 48 is more readily transferred during the liquid capture phase 122. Reducing the time duration of the liquid capture phase 122 reduces the amount of time that pressurized gas is applied through the casing chamber 48. During the time that the casing chamber 48 is pressurized, the natural formation pressure is ineffective or less effective to produce natural gas. Minimizing the time duration of the liquid capture phase 122 therefore allows the natural earth formation pressure to remain more effective and less impeded to flow gas and liquid into the well for larger proportion of each gas recovery cycle 120.

The gas recovery apparatus 20 of the present invention has the potential to continue producing natural gas from wells significantly beyond the commonly-considered end of a well's lifetime. Consequently, it may be possible to produce the last few percent of the oil and gas reserves contained in the hydrocarbon-bearing zone. The well will be commercially viable at a far lower formation pressure before abandonment. A typical plunger lift system needs about 300 PSI of natural formation pressure to produce from a 5,000 foot well. The gas recovery apparatus 20 of the present invention can operate the well down to 5 PSI of pressure in the casing chamber and less than 50 PSI of natural formation pressure. Most importantly, the liquid reduction phase used in conjunction with the three chamber evacuation phase benefits the other phases of the gas recovery cycle to achieve improved and more efficient gas production, thereby making it efficient and economic to work wells that may have already reached a point where it would otherwise be uneconomical to work those wells using other techniques. Many other advantages and improvements will be apparent upon gaining a complete understanding of the improvements and significance of the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

The invention claimed is:

1. A method of recovering natural gas from a well in a multiple phase gas recovery cycle, the well having a casing chamber defined by a casing within the well, a production chamber within a production tubing inserted into the casing chamber and a lift chamber defined by a lift tube inserted within the production chamber, the well also including a one-way valve separating the production chamber from the casing chamber; the gas recovery cycle including a three chamber evacuation phase in which a relatively low pressure is applied within the casing chamber, production chamber and lift chamber to cause the relatively low pressure to augment natural earth formation pressure and flow more liquid and gas into the casing chamber than would flow only from the natural formation pressure, a liquid capture phase in which relatively high pressure gas is applied to the casing chamber to move liquid within the casing chamber through the one-way valve into the production chamber, and a liquid removal phase in which relatively high pressure gas is applied to the production chamber to close the one-way valve and to isolate the production chamber from the casing chamber and to lift liquid isolated in the production chamber up the lift chamber, and a liquid reduction phase executed after the three chamber evacuation phase and before the liquid capture phase by:

applying relatively high pressure within the production chamber to close the one-way valve and to isolate the production chamber from the casing chamber and to lift the liquid accumulated within the production chamber during the three chamber evacuation phase out of the well through the lift chamber; while maintaining the relatively low pressure within the casing chamber.

2. A method as defined in claim 1, further comprising:

flowing natural gas from the casing chamber out of the well during the liquid reduction phase.

3. A method as defined in claim 1, further comprising:

beginning the liquid reduction phase after sensing a predetermined amount of natural gas flow from the casing chamber out of the well.

4. A method as defined in claim 1, further comprising:

beginning the liquid reduction phase after sensing a predetermined pressure of natural gas in the casing chamber.

5. A method as defined in claim 1, further comprising:

beginning the liquid reduction phase after sensing a predetermined reduction in natural gas flow from the casing chamber out of the well and after sensing a predetermined pressure of natural gas in the casing chamber.

6. A method as defined in claim 1, further comprising:

reducing the amount of liquid to be lifted during the liquid removal phase by lifting liquid during the liquid reduction phase.

7. A method as defined in claim 6 wherein the pressurized gas used during the gas recovery cycle to lift liquid through the lift chamber is supplied by a compressor having a predetermined capacity, and the method further comprises:

establishing the quantity of liquid to be lifted during the liquid reduction phase to not exceed the predetermined capacity of the compressor.

8. A method as defined in claim 7, further comprising:

reducing the quantity of liquid to be lifted during the liquid removal phase by executing the liquid reduction phase; and establishing the quantity of liquid to be lifted during the liquid removal phase to not exceed the predetermined capacity of the compressor.

9. A method as defined in claim 8, further comprising:

beginning the liquid reduction phase after sensing a predetermined reduction in natural gas flow from the casing chamber out of the well and after sensing a predetermined pressure of natural gas in the casing chamber; and selecting the predetermined reduction of natural gas flow from the casing chamber and the predetermined pressure of natural gas in the casing chamber at which to begin the liquid reduction phase to correlate to a column of accumulated liquid within the casing chamber at the well bottom.

10. A method as defined in claim 9, further comprising:

selectively beginning the liquid reduction phase prior to the column of accumulated liquid presenting a hydrostatic head pressure greater than the natural earth formation pressure.

11. A method as defined in claim 1, further comprising:

lifting quantities of liquid during the liquid reduction and liquid removal phases to maximize the duration of the three chamber evacuation phase.

12. A method as defined in claim 1, further comprising:

ending the liquid removal phase after sensing predetermined pressures in the production and lift chambers.

13. A method as defined in claim 1, further comprising:

preventing substantial liquid in the production chamber and the lift chamber from flowing into the casing chamber during the liquid reduction phase.

14. A method as defined in claim 1, further comprising:

preventing substantial liquid in the casing chamber from flowing into the production chamber and the lift chamber during the liquid reduction phase.

15. A method of recovering natural gas from a well in a multiple phase gas recovery cycle, the well having a casing chamber defined by a casing within the well, a production chamber within a production tubing inserted into the casing chamber and a lift chamber defined by a lift tube inserted within the production chamber, the well also including a valve separating the production chamber from the casing chamber; the gas recovery cycle including a casing evacuation phase in which a relatively low pressure is applied within the casing chamber to cause the relatively low pressure to augment natural earth formation pressure and flow more liquid and gas into the casing chamber than would flow only from the natural formation pressure, a liquid capture phase in which liquid from the casing chamber is moved through the valve into the production chamber, and a liquid removal phase in which liquid isolated in the production chamber by the valve is lifted up the lift chamber and out of the well, and a liquid reduction phase executed after the evacuation phase and before the liquid capture phase by:

lifting liquid accumulated within the production chamber during the evacuation phase out of the well through the lift chamber; while maintaining the relatively low pressure within the casing chamber.

16. A method as defined in claim 15, further comprising:

flowing natural gas from the casing chamber out of the well during the liquid reduction phase.

17. A method as defined in claim 15, further comprising:

beginning the liquid reduction phase after sensing a predetermined amount of natural gas flow from the casing chamber out of the well.

18. A method as defined in claim 15, further comprising:

beginning the liquid reduction phase after sensing a predetermined pressure of natural gas in the casing chamber.

19. A method as defined in claim 15, further comprising:

beginning the liquid reduction phase after sensing a predetermined reduction in natural gas flow from the casing chamber out of the well and after sensing a predetermined pressure of natural gas in the casing chamber.

20. A method as defined in claim 15, further comprising:

reducing the amount of liquid to be lifted during the liquid removal phase by lifting liquid during the liquid reduction phase.

21. A method as defined in claim 15, further comprising:

applying relatively high pressure to lift the liquid accumulated within the production chamber during evacuation phase out of the well through the lift chamber.

22. A method as defined in claim 21 wherein the pressurized gas used during the gas recovery cycle to lift liquid through the lift chamber is supplied by a compressor having a predetermined capacity, and the method further comprises:

establishing the quantity of liquid to be lifted during the liquid reduction phase to not exceed the predetermined capacity of the compressor.

23. A method as defined in claim 22, further comprising:

reducing the quantity of liquid to be lifted during the liquid removal phase by executing the liquid reduction phase; and establishing the quantity of liquid to be lifted during the liquid removal phase to not exceed the predetermined capacity of the compressor.

24. A method as defined in claim 23, further comprising:

beginning the liquid reduction phase after sensing a predetermined reduction in natural gas flow from the casing chamber out of the well and after sensing a predetermined pressure of natural gas in the casing chamber; and selecting the predetermined reduction of natural gas flow from the casing chamber and the predetermined pressure of natural gas in the casing chamber at which to begin the liquid reduction phase to correlate to a column of accumulated liquid within the casing chamber at the well bottom.

25. A method as defined in claim 24, further comprising:

selectively beginning the liquid reduction phase prior to the column of accumulated liquid presenting a hydrostatic head pressure greater than the natural earth formation pressure.

26. A method as defined in claim 15, further comprising:

lifting quantities of liquid during the liquid reduction and liquid removal phases to maximize the duration of the evacuation phase.

27. A method as defined in claim 15, further comprising:

ending the liquid removal phase after sensing predetermined pressures in the production and lift chambers.

28. A method as defined in claim 15, further comprising:

preventing substantial liquid in the production chamber and the lift chamber from flowing into the casing chamber during the liquid reduction phase.

29. A method as defined in claim 15, further comprising:

preventing substantial liquid in the casing chamber from flowing into the production chamber and the lift chamber during the liquid reduction phase.

30. A method of recovering natural gas from a well extending from the earth surface to a subterranean earth formation from which gas and liquid are produced at a bottom of the well and transported from the bottom of the well through a casing chamber, a production chamber and a lift chamber extending between the well bottom and the earth surface; the method executed by using a multiple phase production cycle, the multiple phase production cycle including an evacuation phase in which a relatively low gas pressure is applied to the casing chamber, the production chamber and the lift chamber to communicate through the chambers to the well bottom and with the earth formation from which the gas and liquid are produced, and the multiple phase production cycle also including a liquid reduction phase which is executed separately from a liquid removal phase during each production cycle; the liquid reduction phase and the liquid removal phase each including:

applying a relatively high pressure to the production chamber while applying a relatively low pressure to the casing chamber, and opening the lift chamber to flow liquid and gas therethrough to the earth surface; and wherein each production cycle involves:

removing liquid accumulated in the production chamber and lift chamber during the evacuation phase by executing the liquid reduction phase; and removing liquid accumulated in the casing chamber during the production cycle by executing the liquid removal phase.

31. A method as defined in claim 30 wherein the evacuation phase includes accumulating gas and liquid from the earth formation within the casing chamber, the production chamber and the lift chamber at the bottom of the well, the method further comprising:

flowing liquid from the production chamber to the lift chamber and from the lift chamber to the earth surface during the liquid reduction phase.

32. A method as defined in claim 31, further comprising:

preventing substantial liquid from flowing from the production chamber into the casing chamber during the liquid reduction phase.

33. A method is defined in claim 31, further comprising:

flowing at least some of the gas from the casing chamber directly out of the well during at least one of the liquid reduction phase or the liquid removal phase.

34. A method is defined in claim 31, further comprising:

establishing the relatively low pressure at a pressure which is less than atmospheric pressure at the earth surface.

35. A gas recovery apparatus for producing natural gas from a well and delivering the produced natural gas to a sales conduit, the well extending from the earth surface into a subterranean earth formation where the natural gas and liquid enter the well, the apparatus including tubing inserted into the well to create a casing chamber in fluid communication with the earth formation and a production chamber and a lift chamber which are separate from one another within the well, the apparatus also including a one-way valve separating the production chamber from the casing chamber, the gas recovery apparatus further comprising:

a compressor having a suction manifold and a discharge manifold, the compressor creating a flow of relatively low pressure gas in the suction manifold and a flow of relatively high-pressure gas in the discharge manifold;

control valves connecting each of the casing chamber, the production chamber and the lift chamber to the suction manifold and the discharge manifold to establish selective fluid communication between the suction manifold and each of the casing chamber, the production chamber and the lift chamber and to establish selective fluid communication between the discharge manifold and each of the casing chamber and the production chamber, the control valves also connecting the lift chamber and the discharge manifold to the sales conduit to establish selective fluid communication between the lift chamber and the discharge manifold and the sales conduit;

a controller programed to supply control signals to the control valves to establish an opened state of each valve to permit fluid communication therethrough and to establish a closed state of each valve to prevent fluid communication therethrough; the controller delivering a sequence of control signals to the control valves to establish the opened and closed states of the control valves which establish fluid communication conditions through the casing chamber, the production chamber, the lift chamber and into the sales conduit during a multi-phase gas recovery cycle; the gas recovery cycle including a liquid capture phase during which pressurized gas supplied by the compressor moves liquid from the casing chamber through the one-way valve into the production chamber, a liquid removal phase in which pressurized gas supplied by the compressor lifts liquid out of the well from the production chamber through the lift chamber, a three chamber evacuation phase executed by applying relatively low pressure within the casing chamber, production chamber and lift chamber to augment natural earth formation pressure in moving liquid and gas into the casing chamber, and a liquid reduction phase executed after completion of the evacuation phase and before executing the liquid capture phase, the liquid reduction phase executed by applying relatively low pressure within the casing chamber and relatively high pressure within the production chamber while the lift chamber is opened and connected to the sales conduit; and wherein:

the controller establishes the states of the control valves during the liquid capture phase to establish fluid communication between the discharge manifold and the casing chamber and to establish fluid communication between the suction manifold and the production chamber and the lift chamber;

the controller establishes the states of the control valves during the liquid removal phase to establish fluid communication between the discharge manifold and the production chamber and to establish fluid communication between the suction manifold and the casing chamber;

the controller establishes the states of the control valves during the evacuation phase to establish fluid communication between the suction manifold and the casing chamber, the production chamber and the lift chamber; and the controller establishes the states of the control valves during the liquid reduction phase to establish fluid communication between the suction manifold and the casing chamber, to establish fluid communication between the discharge manifold and the production chamber, and to establish fluid communication between the lift chamber and the sales conduit.

36. A gas recovery apparatus as defined in claim 35, further comprising:

pressure sensors connected to sense pressure within the casing chamber, the production chamber and the lift chamber, the pressure sensors delivering pressure signals to the controller related to the sensed pressure within the casing chamber, the production chamber and the lift chamber;

flow sensors to sense the flow of natural gas from the lift chamber to the sales conduit and from the casing chamber to the sales conduit, the flow sensors delivering flow signals to the controller related to the sensed flow from the lift chamber to the sales conduit and from the casing chamber to the sales conduit, and wherein:

the controller selectively terminates each phase of the gas recovery cycle and establishes the next phase of the gas recovery cycle based on the pressure signals and the flow signals, and wherein the apparatus further comprises:

an additional control valve connecting the casing chamber to the sales conduit to establish selective fluid communication between the casing chamber and the sales conduit, and wherein:

the controller establishes the state of the additional control valve to establish fluid communication between the casing chamber and the sales conduit during the liquid reduction phase.

* * * * *